United States Patent [19]

Waldron

[11] Patent Number: 4,578,824

[45] Date of Patent: Apr. 1, 1986

[54] GARMENT FASTENING

[75] Inventor: John K. Waldron, St. Albans Merts, United Kingdom

[73] Assignee: Burberrys Limited, England

[21] Appl. No.: 648,577

[22] Filed: Sep. 10, 1984

[30] Foreign Application Priority Data

Jan. 20, 1984 [GB] United Kingdom ..... 8401499

[51] Int. Cl.[4] ..... A41D 3/02; A41F 9/00

[52] U.S. Cl. ..... 2/96; 2/221; 2/237

[58] Field of Search ..... 2/96, 221, 237, 220, 2/236, 76

[56] References Cited

U.S. PATENT DOCUMENTS

| | | | |
|---|---|---|---|
| 2,427,637 | 9/1947 | Verti | 2/237 |
| 2,467,714 | 4/1949 | Wellstatter | 2/96 X |
| 2,541,713 | 2/1951 | Neilson | 2/237 |

FOREIGN PATENT DOCUMENTS

| | | | |
|---|---|---|---|
| 265826 | 8/1913 | Fed. Rep. of Germany | 2/96 |
| 72789 | 1/1930 | Sweden | 2/96 |

*Primary Examiner*—H. Hampton Hunter

*Attorney, Agent, or Firm*—Limbach, Limbach & Sutton

[57] ABSTRACT

A garment fastening arrangement comprising a plurality of lengthwise adjustable waistbands, belts, straps, cords or ties arranged in co-operative sets of interengageable belt portions, with at least a pair of associated interengageable rear belt portions with respective interengageable fastening means and a front set of at least 3 interengageable belt portions with respective interengageable fastening means, one of said set of 3 being attached to a garment front edge and another to the same one side of the garment, with the third being attached to the opposite side of the garment, whereby adjustable interengagement of the three belts of the front set draws and tensions the front of the garment, with overlapping garment edges and panels, while the rear pair of belt portions independently adjustably fastens the rear panel or panels of the garment, for permanent adjustable setting of the garment shape according to the wearer, while the front pair enables fastening and unfastening and slackening of the overall belt tension to allow the garment to be put on and taken off and adjusted for comfort in use.

6 Claims, 5 Drawing Figures

GARMENT FASTENING

This invention relates to fastenings and is particularly concerned with a garment fastening, such as a raincoat or trench-coat fastening, which obviates the need for a multiplicity of fastening buttons and button holes arranged in complementary pairs, as are commonly employed, or alternatively a complex zip arrangment, yet afords a secure draught-free closure of overlapped garment edges and which is of neat, clean-cut overall external appearance.

Hitherto known garments have commonly employed some form of waist belt or strap or other form of tie cord in order to secure a garment in a closed condition, but these have generally been regarded as insufficient in themselves, supplementary fastenings, such as buttons or zips having been employed in order to securely fasten or close the overlapped garment edges by positive localised interengagement thereof.

Moreover, with the relatively short garment edge overlap of conventional fastening arrangements such as buttons or zips, the sealing or isolation of the wearer from the environment is not particularly effective, because draughts can very readily pass between gaps between the overlapped fabric edges between the fastening points, and even when a continuous fastening line such as a zip is employed. the line is not necessarily weatherproofed—that is draught proof or rainproof.

The present invention accomodates a greater overlap of garment edges to the extent that a large area of double fabric thickness is provided for extra protection against the elements and inhibition of draughts etc., and yet the fastening is centrally arranged in respect of a single primary fastening arrangement of belts or belt portions.

According to the invention there is provided garment fastening or tie comprising a plurality of belt, strap or tie cord portions, co-operatively disposed with respect to a plurality of respectively associated adjustable fastening means such as buckles through which a belt portion may be threaded or passed or attached thereto, one belt portion being arranged for disposition on one side of the garment by means of attachment at its outer end, its inner end being free and co-operatively disposed with respect to a pair of belt portions arranged for disposition generally on the opposite side of the garment by respective means of attachment at their respective outer ends, their respective inner ends being provided with adjustable fastening means, such as threadable buckles, through which said free end of the first belt portion is threadable, passable or may be engaged in turn or successively in order to effect fastening which is adjustable according to the length of belt threaded there through or engaged therewith, said second and third belt portions being disposed one to overlie the other with both underlying the first belt proportion when in the fastened condition.

The garment may thus be provided with and accomodate one or more extra fabric portions to form a double overlap, which is tied by the belt fastening arrangement, the overall periphery or width of the garment being correspondingly greater in the manner of a cloak style.

By fastening at a multiplicity of points rather than a single point, the gathering of the garment can be spread more uniformally and therefore with greater comfort to the wearer, but may also be gathered in localised areas for visual appeal whilst maintaining comfort of the wearer. In this regard the fastening according to the invention is particularly suitable for gathering folds into a gusseted seam or slit incorporated into the garment for that purpose.

By the use of a single or primary fastening assembly freedom of movement and wearing comfort, whilst retaining internal circulation of air and excluding external draught and mixing with external air yet providing some degree of ventilation if required is preserved.

It should be appreciated that a simple loose tie cord, secured for example by a knot at the ends of a tie, cannot generally quickly be secured or released readily and allows no give to accommodate movement of the wearer, for example in bending and indeed in terms of visual appeal the entire garment is gathered by a simple essentially uniformally tensions tie resulting in the appearance of a tied bag or sack which does not enhance the overall appearance of the garment or the wearer.

By employing a multiplicity of ties or tie portions at or around the general waist area of the garment, the tie tension can be spread selectively, allowing fastening and unfastening or slackening, whilst retaining a certain pre-tension fit over some areas, for example the rear, to accomodate stylistic considerations.

It is envisaged that the fastening assembly will be disposed at or around waist level in the garment, but other positions are possible according to the garment style.

There have been earlier proposals of a single belt fastening arrangement, such as for example taught in our U.K. patent number 21,716 of 1912, the latter arrangement utilises a single pair of belts of which one belt portion was turned back on itself through a loop on the opposite side of the garment and fastened at the rear of the garment with a single tension strap effecting a useful gathering of the material of the garment at waist level and presenting a substantial unbelted appearance at the front because of the predominent appearance of the large and extended overlapping garment zone. The consequent 'tunic style' with military, official or authoritarian overtones, is not compatible with a wide range of contemporary garment styles and the rear fastening is not particularly convenient.

By means of the present invention a portion of the garment itself at waist level is used as a form of tensioning belt between the respective spaced points of attachment on one side of the garment of the second and third associated belt portions carrying respective buckles of other fastening arrangements.

There now follows a description of a particular embodiment of the invention, by way of example only, with reference to the accompanying diagrammatic, illustrative drawings, in which.

Figure 1:
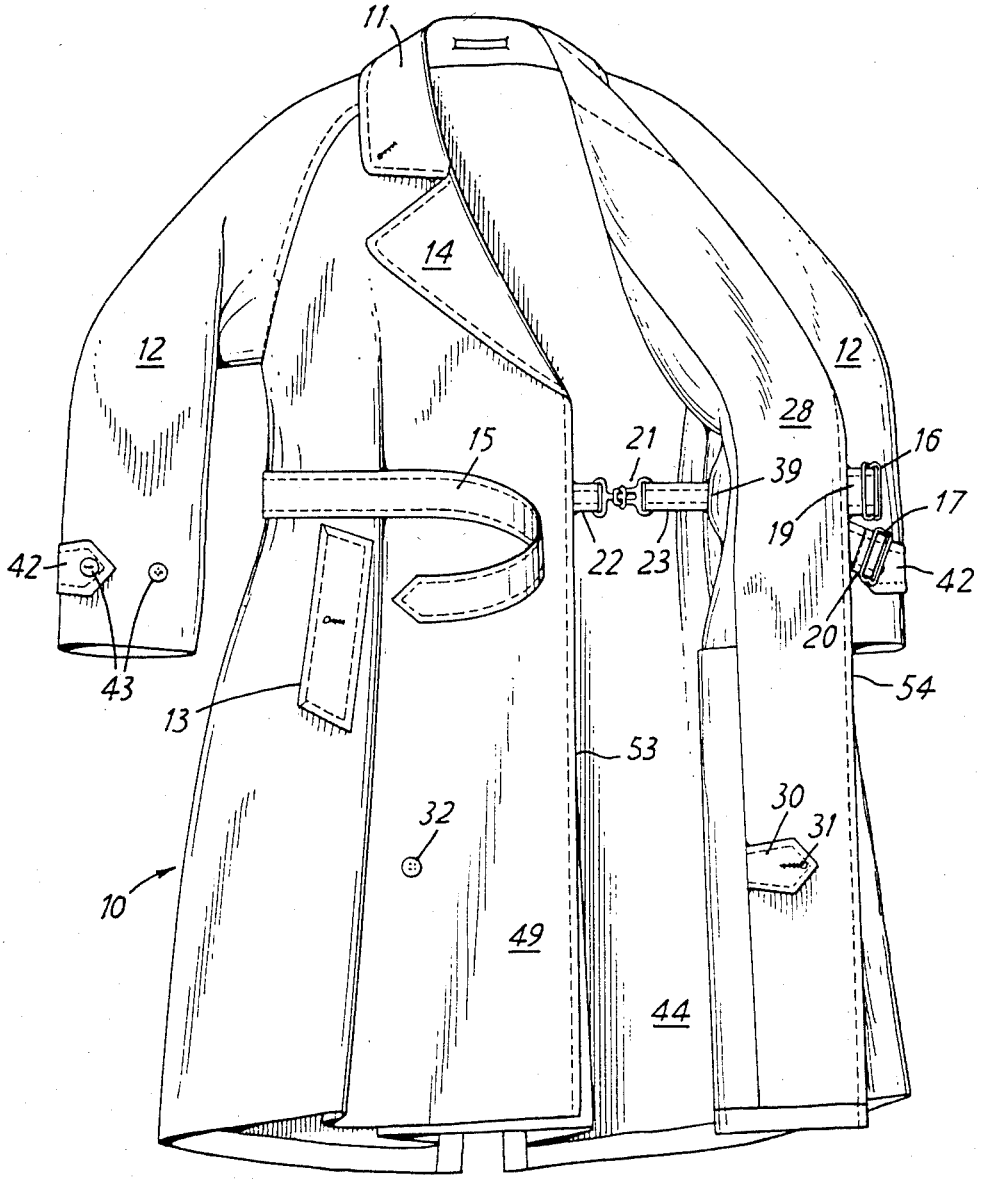
FIG. 1 shows a partially open front view of a garment comprising a raincoat in the trenchcoat style.

Referring to the drawings, a garment 10 comprises a raincoat in the trenchcoat style with sleeves 12 of generous proportions, with provision for gathering at the wrist area by means of co-operatively associated straps 42 and alternative locating buttons 43, and very deep or substantial collar 11 which may be turned up and similarly substantial lapels 14. These features all lead to the extra weather-shielding qualities of the garment.

The garment 10 also accomodates generous or substantial front panels 49, particularly on one side, (to the left as illustrated in FIG. 1, but to the wearer's right side) whereby a considerable degree of overlap of the garment front edges 53,54 may be effected for improved weatherproofing and draughtproofing of the garment when worn and as a consequence to achieve a certain distinctive external style, in particular uncluttered by a multiplicity of individual fastening means such as buttons in a row along the garment edges.

The garment 10 is provided with a front belt assembly comprising a main (outer) front belt 15 attached to one side of the garment and co-operatively disposed for engagement with a pair of shorter subsidiary belts 19 and 20 attached at their respective outer ends 50 and 41 to spaced points on the opposite side of the garment.

At the rear of the garment is a supplementary rear belt assembly, comprising a pair of belts, which may either be separate from the front belt assembly or a continuation of the various individual fabric lengths thereof, but which are conveniently (although not necessarily) stitched to common attachment points 40 and 41 at their respective outer tied ends. Thus a rear belt portion 26, with a buckle fastening assembly 18 at its free end, is secured at its other end to one side of the garment at an attachment point 40 common to the attachment point of the primary belt 15. A second rear belt portion 35 extends from a side attachment point 41 opposite to the attachment point 40, common to the front belt portion 20 to a free end 37 which is tapered to promote threading through the buckle 18.

It should be appreciated that, when reference is made herein to 'buckles', this is an example of one adjustable fastening arrangement, but others may be employed, such as Velcro (Registered Trade Mark) or press studs and eyelets etc. Moreover, the buckles specifically disclosed are preferably of the type without buckle pins—there being no corresponding (reinforced) eyelet holes in the belt itself.

Of the front belt assembly two associated belt portions 19 and 20 are each provided at their 'free' ends with respective fastenings comprising buckles 16 and 17.

The buckles 16, 17 and 18 are secured to their respective belts 19, 20 and 26 by looping of the respective belt end around the buckle center post and stitching of the returned free end back to the body of the belt.

The belt 19 is relatively short, almost stub-like, whereas the belt 20 is somewhat intermediate in length, compared with the length of the belt 19 and the belt 15.

The free end 34 of the belt 15 is tapered to facilitate threading through the buckle 16 of the belt 19 and then successively through the buckle 17 of the belt 20 and is thereafter drawn through a tie loop 33 around the belt 20 for neatness and compactness.

The rear belt assembly is generally used to effect pre-tensioning or setting of the size of the garment according to the wearer, to avoid the need for major re-adjustment upon each occasion the garment is worn. Thus the setting of the belt 35 through the buckle 18 in relation to the belt 26 is adjustably pre-set and the resulting gathered folds of the material are accomodated at the rear of the garment in a rear longitudinal gusset panel 46 attached along stitching lines 48 to the split rear garment panels 47 (see FIG. 2), the adjacent and occasionally abutting or overlapping edges of which are constrained in relative movement by gusset tie strap 45 sewn internally, as shown in FIG. 2.

Figure 2:
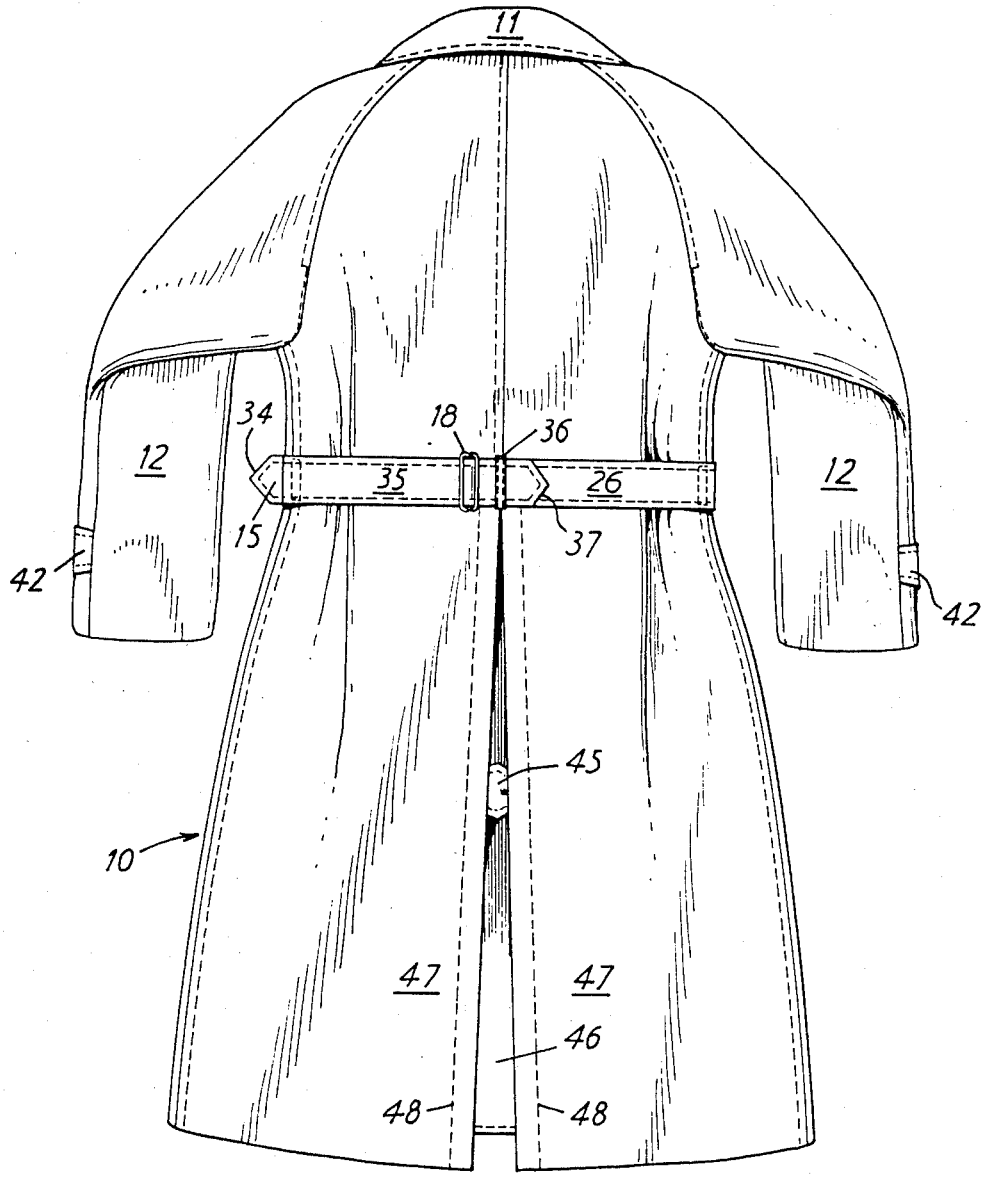
FIG. 2 shows a rear view of the garment shown in FIG. 1.
Figure 3:
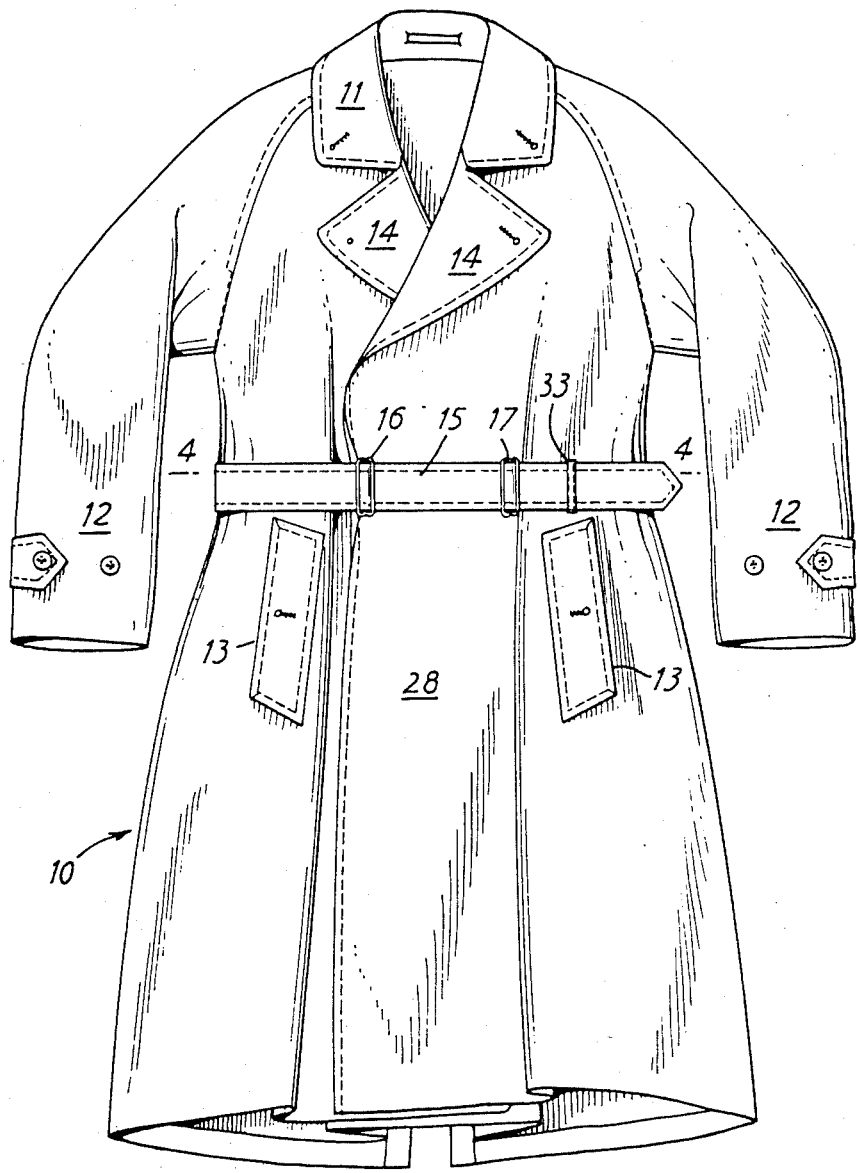
FIG. 3 shows a closed front view of the garment shown in FIGS. 1 and 2.

As will be appreciated from FIGS. 2 and 3 in particular, the overall belt assembly comprising the multiplicity of belts 15, 19, 20, 26 and 35 nevertheless forms a compact and neat outer visual appearance, by the overlapping disposition of the various belts. In particular the belt 15 substantially overlies the belts 19 and 20 when fastened and the belt 35 substantially overlies the belt 26 when fastened.

Moreover the overall belt assembly forms a continuous "belt line" at about the waist level of the garment, which is no more visually intrusive than belts commonly employed on such garments and yet combines extra security for fastening. Specifically, the overlapping side panel 28 is brought right across the front of the garment over the opposite front side panel 49 and is secured in position by the interengagement of the belt 15 and the belt 19 through the adjustable fastening buckle 16, the remainder of that same side portion of the garment then being held captive by the belt 20 threadedly engaged through the adjustable buckle fastening 17 with the remainder of the belt 15.

The overlap will vary according to convention and whether the garment is for male or female wear.

Thus the multiplicity, in fact three in the present embodiment, of individual belt fastening points 19, 40 and 41 spread the tension of the belt fastening action in a desired manner around the garment, whereby selected areas can be given a desired degree of tension and thus the gathering which is required for style, comfort and appearance.

The front belt assembly comprising the belts 15, 19 and 20 are primarily concerned with the opening and closure of the garment for putting on and taking off the garment, or slackening for casual wear, and achieving the final desired fit of the garment around the wearer, whereas the rear belt assembly, comprising the belts 26 and 35, is concerned with initial adjustment of the garment which is an otherwise cloak-like expanse of fabric, in terms of the generous overlap provided for and accomodated by the trenchcoat style, and which might otherwise present an unduly bulbous or sack-like appearance.

Figure 4:
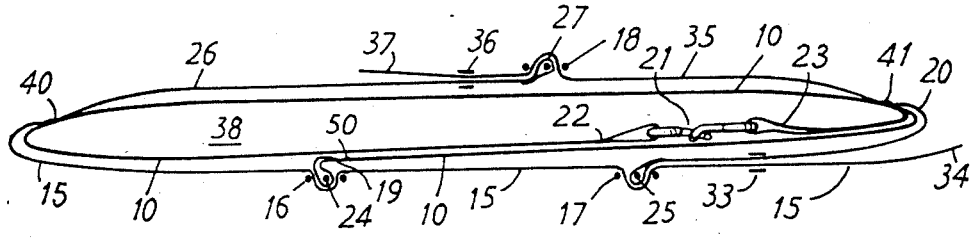
FIG. 4 shows a sectional view along the line 44 in FIG. 3.
Figure 5:
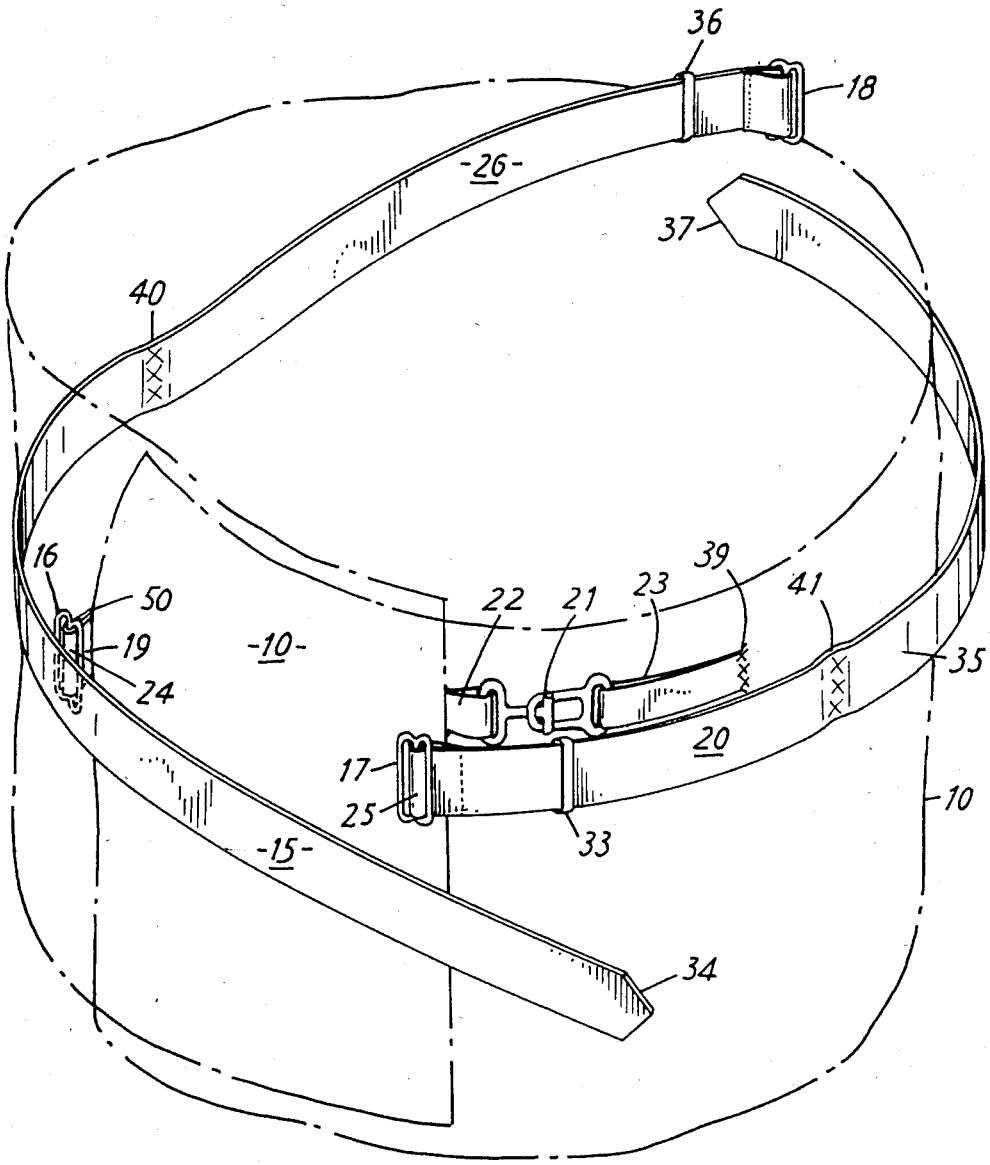
FIG. 5 shows a schematic layout of the belt fastening assembly of the garment shown in FIGS. 1 to 4.

As an extra security, for the convenience of wearing, an internal supplementary tie strap, comprising short straps 22 and 23 interengageable by a T- head and slot buckle 21 is provided between the overlapping garment edges as shown in FIGS. 1, 4 and 5.

A further supplementary tie fastening, comprising an internal fly-strap 30 and a buttonhole 31 co-operatively disposed with respect to a button 32 on the side panel 49, may be provided to stop the lower portion of the garment billowing open—this is particularly convenient for long garments.

It will be appreciated that the shape, size and configuration of the garment, in particular details such as pockets 13, may be varied considerably according to the nature of the garment and the particular style to be achieved and that the multiple belt fastening arrangement or overall belt assembly according to the invention may be adapted in detail or design accordingly, whilst retaining and embodying the functional operating principle set out herein.

It may also be noted that by the use of the relatively short stub or subsidiary belt 19, with its own adjustment or fastening buckle 16 for engagement with primary belt 15, the initial drawing across and tensioning of one garment side across the other may be effected without the need to reverse the direction of the primary belt 15 at the front of the garment and yet the latter may continue to effect tensioned gathering of the front portion of the garment, specifically with the garment sides overlapped and held in position by the belt 19 and buckle 16, by interengagement with the adjustable buckle fastening 17 on the intermediate belt 20.

Notwithstanding the multiplicity of belts, belt or tie portions employed in the belt assembly, there is no danger of losing any part of the assembly, because each belt portion is fastened in its own right to the garment 10. In this regard the common fastening points 40 and 41 are optional, but are particularly convenient if it is desired to use continuous fabric length to form say two successively adjacent belt portions.

The internal supplementary tie belt asssembly 21, 22, 23 ensures that the inner edge of the inner garment front panel is kept pulled across the wearer, at or around chest level and is not allowed to say sag or droop, resulting in an unacceptable sag of fabric causing discomfort to the wearer and impairing the appearance of the garment overall, for example by creating internal folds or bulges and an uneven lower hemline.

I claim:

1. In combination with a garment having overlapping front panels, an improved fastening arrangement comprising a plurality of lengthwise adjustable waistbands arranged in cooperative sets of interengageable belt portions, with at least a pair of associated interengageable rear belt portions with respective interengageable fastening means and a front set of at least 3 interengageable belt portions with respective interengageable fastening means, one of said set of 3 being attached to one front panel of the garment and another being attached to the same front panel of the garment in spaced relationship to the attachment of said one belt portion, with the third being attached to the opposite front panel of the garment, whereby adjustable interengagement of the three belts of the front set draws and tensions the front of the garment, with overlapping garment edges and panels, whilst the rear pair of belt portions independently adjustably fastens a rear panel of the garment, for permanent adjustable setting of the garment shape according to the wearer, whilst the front set enables fastening and unfastening and slackening of the overall belt tension to allow the garment to be put on and taken off and adjusted for comfort of use.

2. A fastening arrangement, as claimed in claim 1, further comprising one or more internal supplementary fastening arrangements for the panels of the garment.

3. A fastening arrangement, as claimed in claim 1, wherein at least part of the belt is arranged to cooperate in gathering the garment waistband shape and size with a gusset in the garment itself to accommodate to a desired fit the contours of the wearer.

4. A fastening arrangement, as claimed in claim 3, wherein the rear pair of belt portions is cooperatively disposed with respect to a rear longitudinal gussetted garment seam, whereby gathered folds of garment material are tucked internally of the material.

5. A fastening arrangement, as claimed in claim 1, wherein each fastening means comprises a buckle and strap.

6. A fastening arrangement, as claimed in claim 1, wherein the garment comprises a trenchcoat.

* * * * *